US011365077B2

(12) United States Patent
Adami

(10) Patent No.: US 11,365,077 B2
(45) Date of Patent: Jun. 21, 2022

(54) ARM FOR AN UNWINDER AND UNWINDER COMPRISING SAID ARM

(71) Applicant: FOSBER S.P.A., Pescaglia (IT)

(72) Inventor: Mauro Adami, Viareggio (IT)

(73) Assignee: Fosber S.p.A., Pescaglia (IT)

( * ) Notice: Subject to any disclaimer, the term of this patent is extended or adjusted under 35 U.S.C. 154(b) by 101 days.

(21) Appl. No.: 16/892,794

(22) Filed: Jun. 4, 2020

(65) Prior Publication Data

US 2020/0391968 A1 Dec. 17, 2020

(30) Foreign Application Priority Data

Jun. 17, 2019 (IT) ..... 102019000009153

(51) Int. Cl.
*B65H 19/10* (2006.01)
*B65H 19/18* (2006.01)

(52) U.S. Cl.
CPC ..... *B65H 19/1863* (2013.01); *B65H 19/1852* (2013.01); *B65H 2701/1762* (2013.01)

(58) Field of Classification Search
CPC ..... B65H 16/04; B65H 16/023; B65H 16/10; B65H 19/10; B65H 19/1852; B65H 19/1863; B65H 23/06
See application file for complete search history.

(56) References Cited

U.S. PATENT DOCUMENTS

| | | | | |
|---|---|---|---|---|
| 3,966,137 | A * | 6/1976 | Schuessler | B65H 23/06 242/422.1 |
| 5,330,126 | A * | 7/1994 | Grischenko | B65H 16/021 242/559 |
| 6,299,099 | B1 * | 10/2001 | Miller | B65H 75/242 242/529 |
| 8,011,409 | B2 | 9/2011 | Adami | |
| 2005/0242224 | A1 * | 11/2005 | Shiraishi | B65H 23/06 242/421.1 |
| 2019/0185283 | A1 | 6/2019 | Adami | |

FOREIGN PATENT DOCUMENTS

| | | | |
|---|---|---|---|
| DE | 10343586 | A1 | 9/2004 |
| DE | 102015201180 | A1 | 7/2015 |
| EP | 3231750 | A1 | 10/2017 |
| GB | 396814 | | 8/1933 |
| JP | H08117847 | A | 5/1996 |

* cited by examiner

*Primary Examiner* — Sang K Kim
(74) *Attorney, Agent, or Firm* — Breiner & Breiner, L.L.C.

(57) ABSTRACT

An arm for an unwinder for unwinding rolls is disclosed. The arm includes an axial engaging member for engaging the rolls. The axial engaging member has a shaft supported by at least two support bearings mounted on the arm, so as to rotate around a rotation axis. A brake is also provided, adapted to act on the shaft. The brake is at least partially arranged between the two support bearings.

25 Claims, 7 Drawing Sheets

ARM FOR AN UNWINDER AND UNWINDER COMPRISING SAID ARM

TECHNICAL FIELD

The present invention relates to improvements to machines for handling rolls of wound web material, such as paper and cardboard rolls. More in particular, disclosed are improvements to unwinders for unwinding rolls and components thereof, especially arms facilitating the unwinding of rolls.

BACKGROUND TO THE INVENTION

In many industrial fields, it is required to unwind rolls of web material to feed it to a converting line, where the web material is converted into other finished or semi-finished products.

For example, for producing corrugated board, continuous paper sheets are used as semi-finished products, unwound from rolls by means of unwinders of the converting line. Some sheets are corrugated. Then, corrugated and non-corrugated sheets are alternately bonded together so as to form the corrugated board.

In the corrugated board converting lines, paper rolls are unwound by traction. The roll is supported by two axial engaging members, also referred to as "tailstocks". The roll is driven into rotation by pulling the paper sheet or web. The tailstocks shall be equipped with brakes for controlling paper unwinding, avoiding rotation of the roll due to inertia, and keeping the web material adequately pulled during unwinding.

Tailstocks are usually carried by a pair of arms of the unwinder, which are provided with a movement towards and away each other, so as to engage the roll with the tailstocks and release it therefrom and to adjust the distance between the tailstocks according to the roll axial dimension. The arms are also provided with a rotation movement around an axis parallel to the axis of the tailstocks, so as to move the roll during the production steps.

In prior art unwinders, the arms have a cylindrical seat projecting from a side of the arm, where support bearings are arranged for supporting a shaft of the tailstock. The shaft extends through the arm and co-acts with a brake carried by the arm on the side opposite the side wherefrom the tailstock projects. The shaft of each tailstock is long and requires a complex support system. Moreover, this known arrangement is complex, expensive and bulky.

It would be therefore useful to have an arm for an unwinder for unwinding rolls, and an unwinder using pairs of these arms, that overcome or alleviate the drawbacks of the known unwinders.

SUMMARY OF THE INVENTION

According to one aspect, an arm for an unwinder for unwinding rolls is disclosed, comprising an axial engaging member for engaging the rolls, also referred to as "tailstock", having a shaft supported by at least two support bearings mounted on the arm so as to rotate around a rotation axis. The arm further comprises a brake adapted to act on the tailstock shaft.

In this way, the axial bulk of the system constituted by tailstock and brake is reduced. The supports of the tailstock shaft are less stressed, and are therefore simpler and more economical to design, as well as less bulky.

The brake is advantageously arranged at least partially between the two support bearings. The brake is preferably integrally housed between the support bearings.

Essentially, the arm for an unwinder comprises therefore: a tailstock and a brake, which is arranged around the tailstock shaft, advantageously in a space between the two support bearings of the tailstock.

As the brake is arranged around the tailstock shaft, and not aligned with, and at an end thereof, the back end of the tailstock shaft, i.e. the end opposite to the cone of the tailstock engaging the roll, is free. Therefore, auxiliary or ancillary devices or equipment can be associated with the back end of the tailstock. For example, in some embodiments a motor can be applied to the back end of the tailstock for controlling the roll rotation. In other embodiments, to the end back of the tailstock other useful members, sensors, actuators or components, such as accessories or functional units of the arm and the tailstock, can be associated.

Practically, in the distal part of the arm, i.e. in the part opposite to the unwinder structure, to which the arm is connected, a housing can be provided. The brake, or part thereof, may be housed in the housing, which may be defined by two walls transverse with respect to the axis of the tailstock shaft, whilst the support bearings may be mounted in, or associated with, the transverse walls.

The brake may comprise at least a rotating ring, and preferably a plurality of rotating rings, torsionally coupled to the shaft and rotating therewith. The rotating rings may be, for example, coupled to the tailstock shaft by means of a grooved coupling. This allows the rings rigidly to rotate with the shaft and, at the same time, axially to slide along the shaft. The brake may also comprise a braking disc or a plurality of braking discs, mounted interposed between the rotating rings. The braking discs are carried by the arm so as not to rotate with the tailstock shaft and may be provided with a movement parallel to the tailstock axis.

The rotating rings and the braking discs are arranged around the tailstock shaft between the two support bearings. A brake actuator pushes the braking discs and the rotating rings against one another so as to generate a braking torque on the tailstock shaft. The brake actuator may be arranged around the tailstock shaft. Advantageously, also the brake actuator is at least partially arranged in the space between the two support bearings of the tailstock shaft. The brake actuator may be a cylinder-piston actuator, for example a hydraulic actuator.

The actuator may be a single-action cylinder-piston actuator, and the braking discs may be stressed in axial direction so as to be spaced, with respect to the rotating rings, by means of elastic members, for instance helical springs.

In some embodiments, to facilitate the release of the rolls from the arm, this latter may comprise an ejector adapted to eject a roll from the tailstock. The ejector is provided with an actuator and may comprise a movable plate mounted coaxially with the tailstock and adapted to move axially with respect thereto controlled by the ejection actuator. This latter may be housed in the arm, preferably at least partially between the two support bearings of the tailstock shaft.

According to a further aspect, an unwinder is disclosed for unwinding rolls of web material, comprising a bearing structure and at least a pair of arms or preferably two pairs of arms, each configured as described above.

Further features and embodiments of the arms and the unwinder will be described below with reference to the attached drawing.

BRIEF DESCRIPTION OF THE DRAWING

The invention will be better understood by following the description below and the attached drawing, showing a non-limiting embodiment of the invention. More specifically, in the drawing.

DETAILED DESCRIPTION OF AN EMBODIMENT

Figure 1:
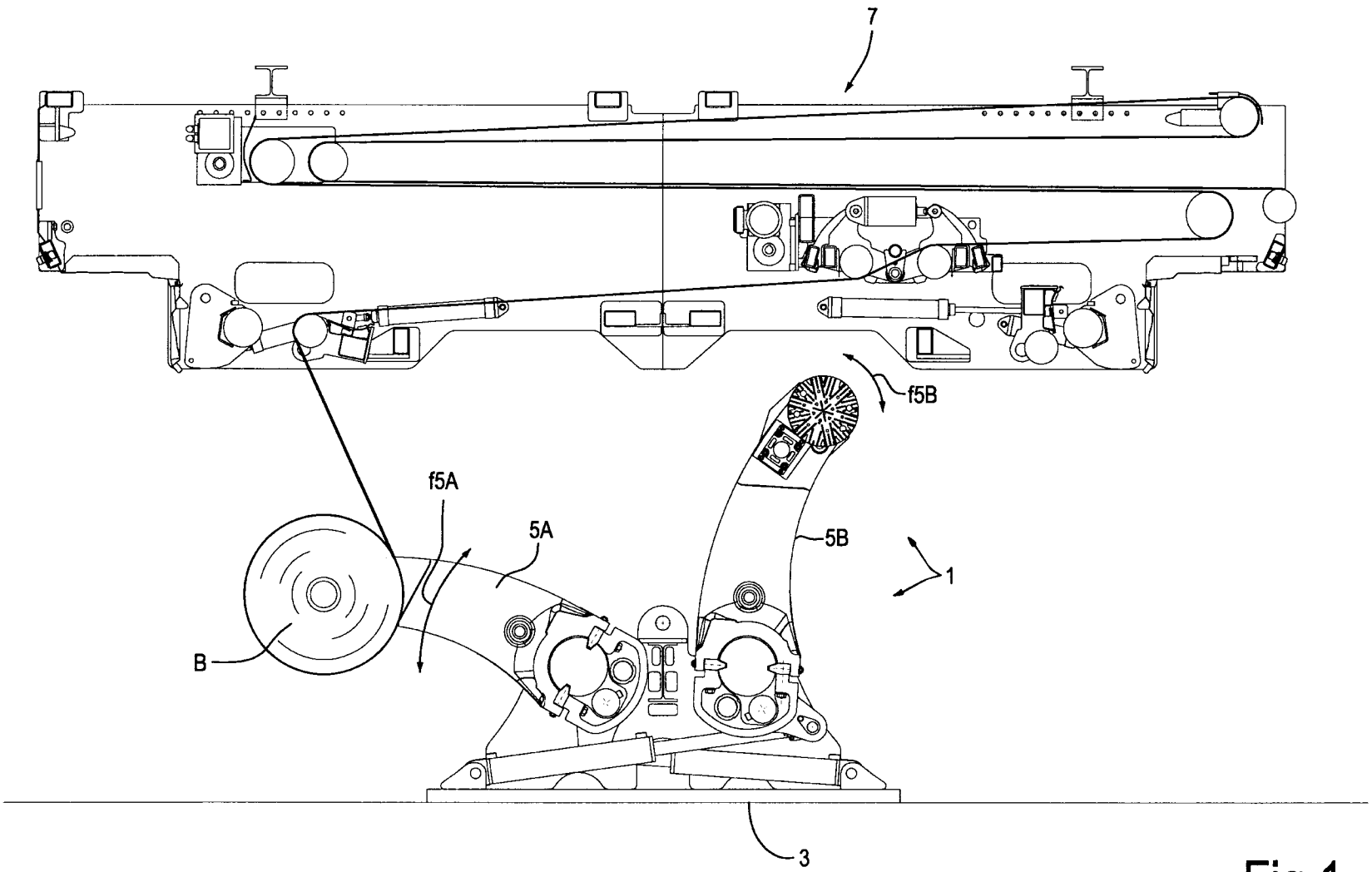
FIG. 1 is a side view of an unwinder according to the present description.
Figure 2:
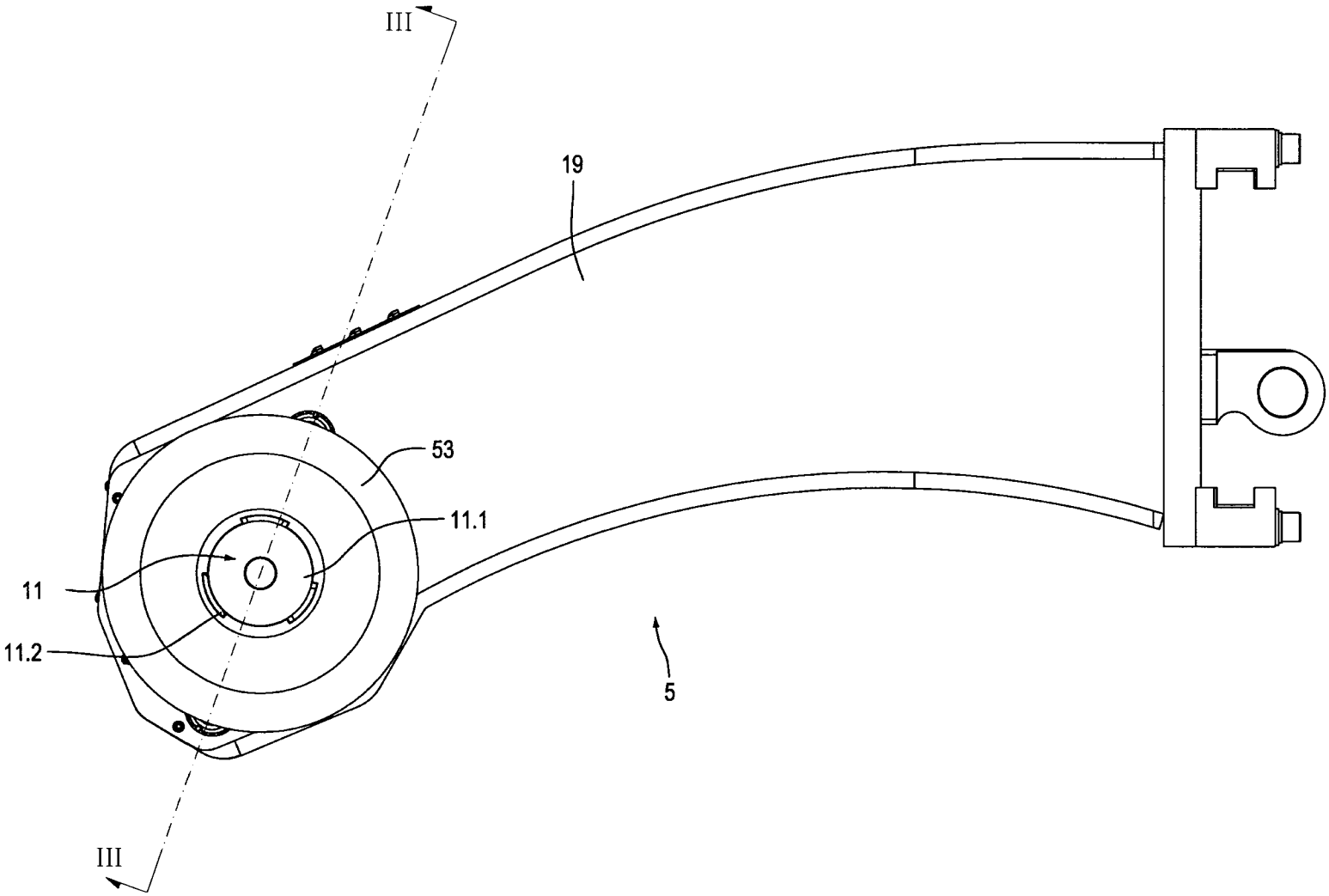
FIG. 2 is a side view of an arm of the unwinder of FIG. 1 from the side of the tailstock.

FIG. 1 schematically shows an unwinder 1 comprising a base or bearing structure 3, to which two pairs of arms 5 are hinged. FIG. 1 shows only one arm for each pair. Each pair of arms 5 is configured to support a roll B of paper or other web material that shall be unwound and fed to a converting line, not shown. A splicer 7 is provided above the arms 5 to join the tail edge of a roll supported by a pair of arms to the leading edge of a standing-by roll supported by the other pair of arms, so as continuously to feed the web material N to the converting line. The detailed features of the unwinder 1 and the splicer 7 are not relevant for this disclosure. Just by way of example, the splicer 7 can be configured as disclosed in U.S. Pat. No. 8,011,409, and the unwinder 1 can be configured as disclosed in EP3464142 or DE102015201180, except for the arms, that will be described below.

The arms, described below, of the unwinder 1 can be advantageously used also for unwinders other than those mentioned above.

The arms 5A, 5B have a rotation movement according to the arrow f5A and f5B respectively, around a horizontal axis allowing to raise and to lower a roll B. The pairs of arms 5A move synchronously according to the arrow f5A. Analogously, the arms 5B move synchronously according to the arrow f5B. Moreover, each arm 5A, 5B is provided with a translation movement with respect to the base 3 according to a direction orthogonal to the plane of FIG. 1, i.e. parallel to the rotation axis. Thanks to this movement, the arms of each pair can move towards, and away from, each other to engage rolls B of variable axial dimensions.

FIGS. 2 to 5 show in detail one of the four arms, with which the unwinder 1 is equipped. The arms 5A, 5B are equal to each other two by two, and are symmetrical to by two; therefore, it is enough to describe only one of these arms. In FIGS. 2 to 5 the arm is indicated with number 5.

The arm 5 comprises a proximal end 5.1, i.e. an end adjacent to the base 3, and a distal end 5.2, i.e. an end spaced from the base 3. The arm 5 carries, at the distal end 5.2 thereof, a unit comprising an axial engaging member for engaging the rolls B, here below simply called "tailstock", and auxiliary and ancillary elements, members and actuators for the use of the tailstock.

The tailstock is indicated with number 11 and has a conical or frusto-conical end 11.1 projecting from the arm 5. In the illustrated embodiment, the tailstock 11 has radially expandable elements 11.2, adjacent to the truncated-conical end 11.1. The elements 11.2 are provided with a radial expansion and contraction movement in a direction orthogonal to the axis A-A of the tailstock 11. The axis A-A is parallel to the rotation axis of the arm 5 with respect to the base 3.

The tailstock 11 further comprises a shaft 11.3 extending towards the inside of a housing 13 provided in the arm 5. The shaft 11.3 is supported on the arm 5 by two support bearings 15 and 17. In the illustrated embodiment, the support bearings 15 and 17 are mounted at walls 19, 21 of the arm 5, which are transverse to the tailstock axis A-A. The walls 19 and 21 laterally delimit the housing 13, through which the shaft 11.3 of the tailstock 11 extends.

The tailstock 11 is provided with a brake 23, configured to brake the rotation of the tailstock 11 during the operation of the unwinder 1, for example to stop the rotation of the roll B, or to keep the desired traction of the web material unwound from the reel. In the illustrated embodiment, the brake 23 is arranged inside the housing 13 provided in the arm 5, between the transverse walls 19 and 21. In this way, the axial length of the tailstock 11 is reduced and the end of the shaft 11.3 of the tailstock 11 opposite to the truncated-conical end 11.1 is made free and can be accessed from the back.

In the illustrated embodiment, the brake 23 comprises braking members and a brake actuator. The braking members comprise a series of rotating rings 25 coupled to, and coaxial with, the shaft 11.3 of the tailstock 11. The rotating rings 25 are connected to the shaft 11.3 so as to rotate integrally therewith, remaining at least partially free of translating with respect to the shaft 11.3 in axial direction, i.e. parallel to the axis A-A of the tailstock 11. In some embodiments, the rotating rings 25 are coupled to the shaft 11.3 through a splined profile 11.4 provided on the shaft 11.3. In this way, the rotating rings 25 rotate integrally with the tailstock 11 but can move towards, and away from, each other according to the double arrow f23.

Braking discs 27 are interposed between the rotating rings 25, the discs being coupled to the arm 5 so as not to rotate around the axis A-A of the tailstock 11. The braking discs 27 can be coupled, for example, to one or more pins 29 parallel to the axis A-A of the tailstock 11 and rigidly fastened to the arm 5. The braking discs 27 are coaxial to the shaft 11.3 of the tailstock 11. Pads 31, made of high-friction material and integral with the rotating rings 25 or, preferably, with the discs 27, can be interposed between the rotating rings 25 and the braking discs 27.

By pressing the braking discs 27 and the rotating rings 25 against one another in a direction parallel to the axis A-A, a braking torque is generated on the tailstock shaft 11.3. This braking action is given by a brake actuator 33. Advantageously, the brake actuator 33 is a cylinder-piston actuator. Preferably, the actuator is a pneumatic cylinder-piston actuator, for the sake of simplicity of the supply circuit.

Figure 3:
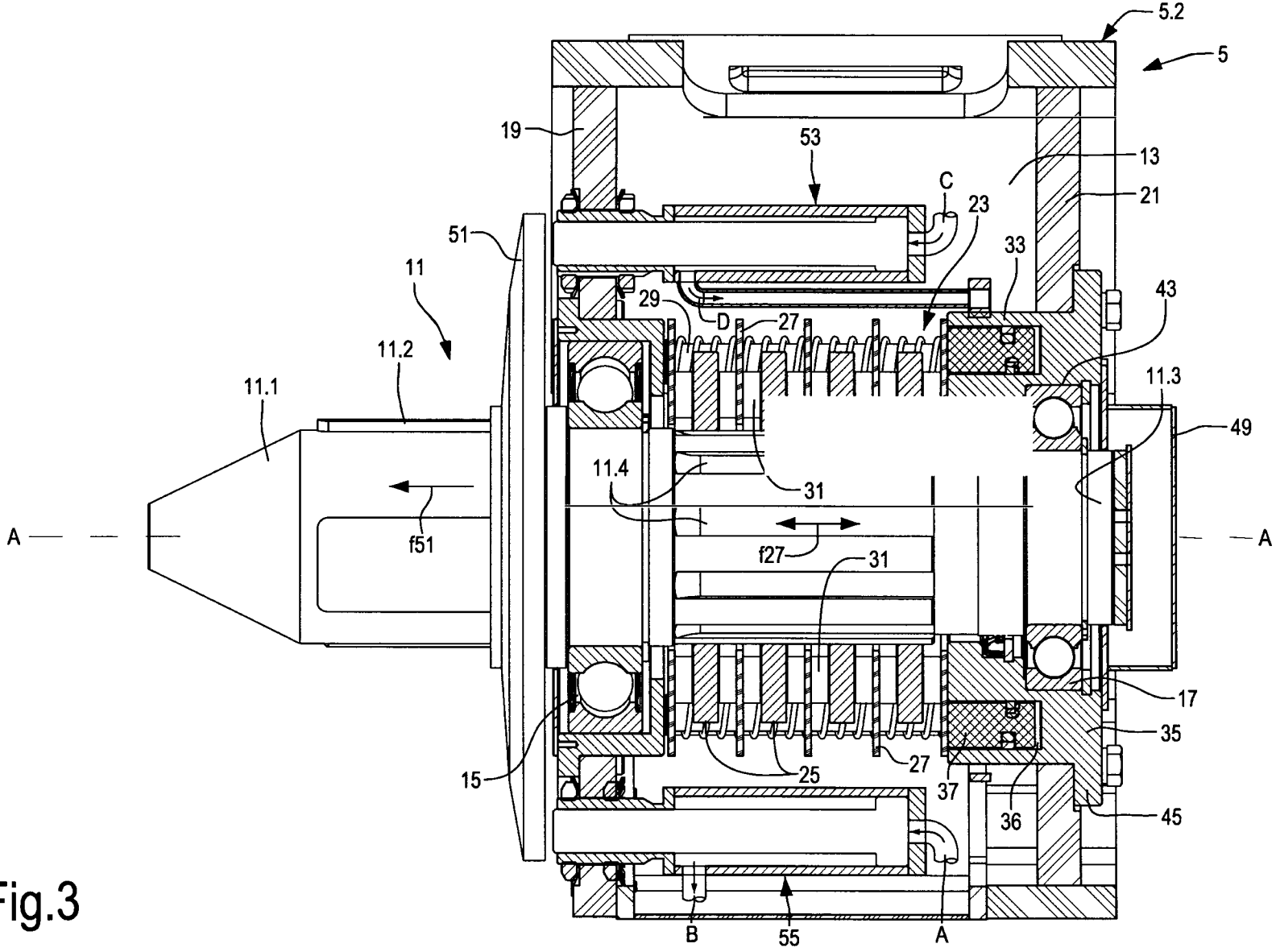
FIG. 3 is a cross-section according to the line of FIG. 2.
Figure 4:
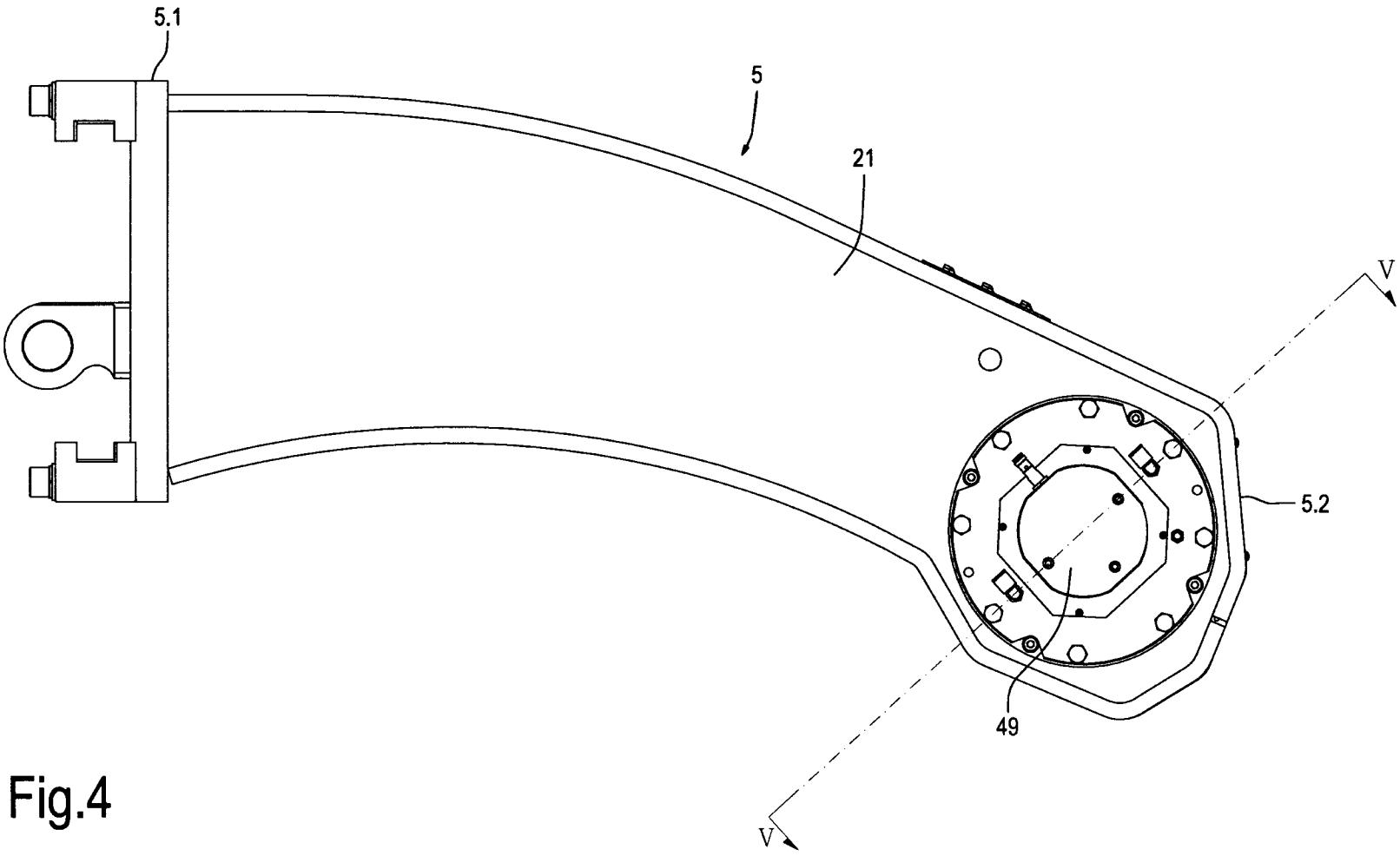
FIG. 4 is a side view of an arm of the unwinder of FIG. 1 from the side opposite to the tailstock.
Figure 5:
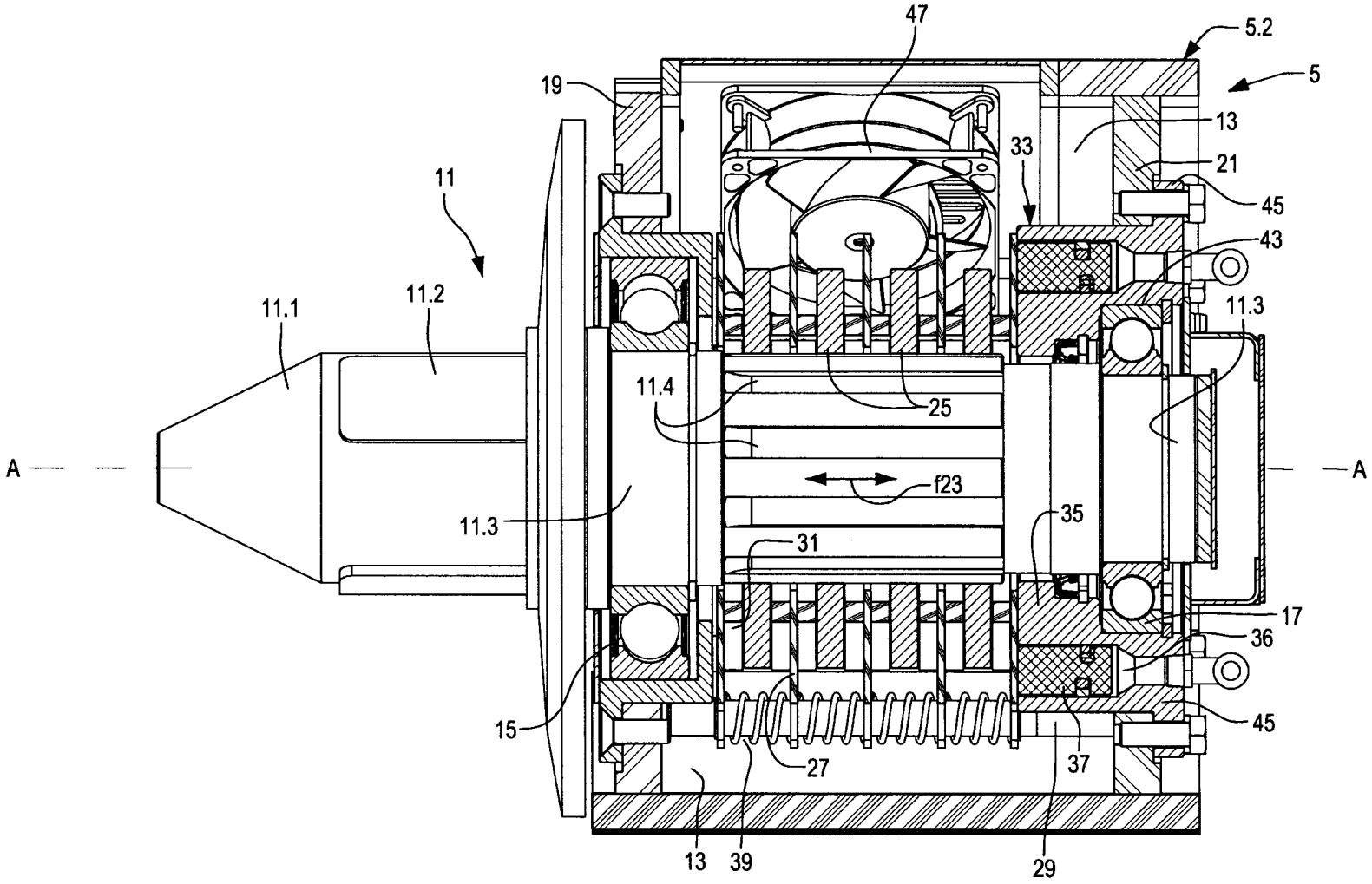
FIG. 5 is a cross-section according to V-V of FIG. 4.
Figure 6:
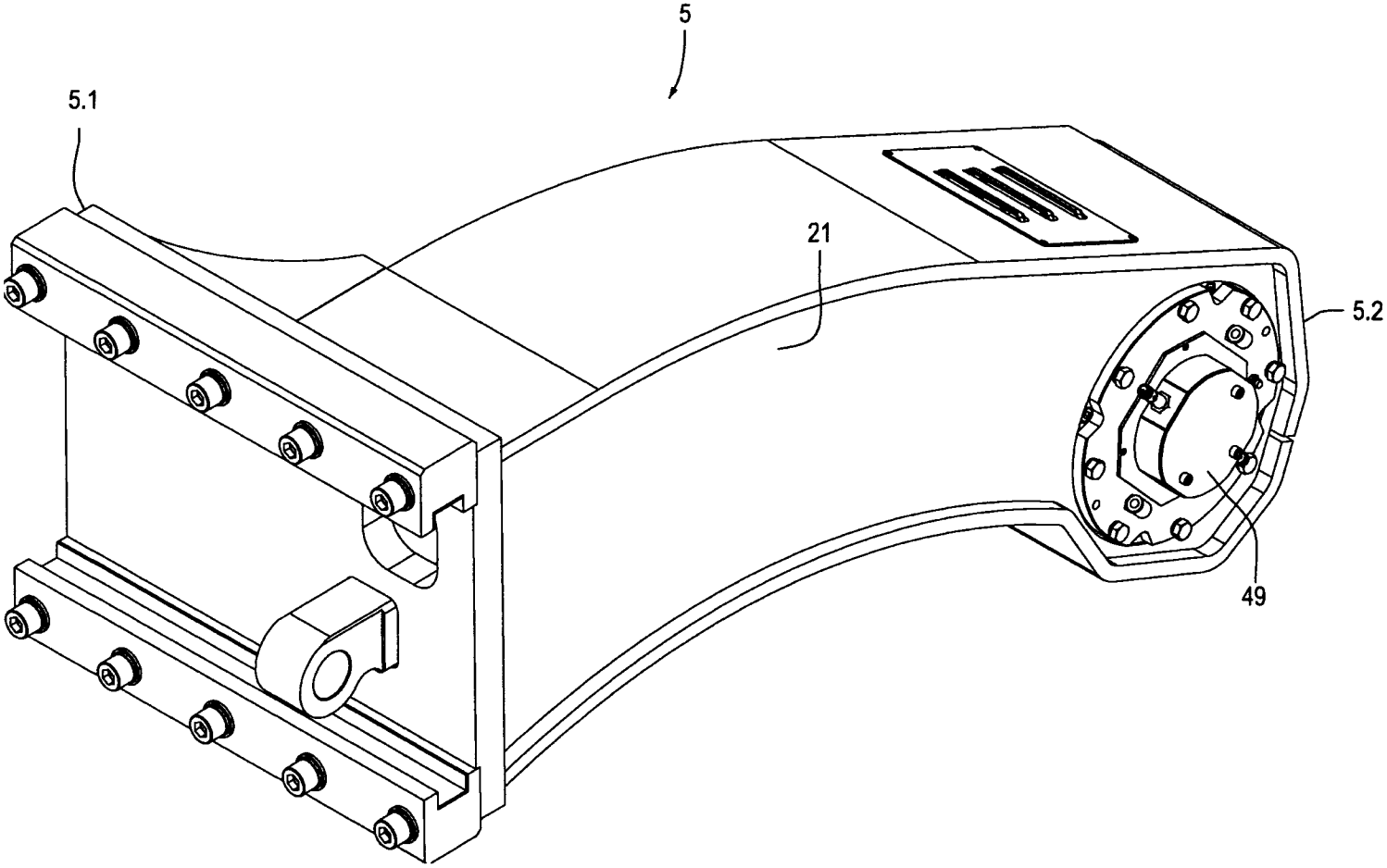
FIGS. 6 and 7 are isometric views of an arm of the unwinder.
Figure 7:
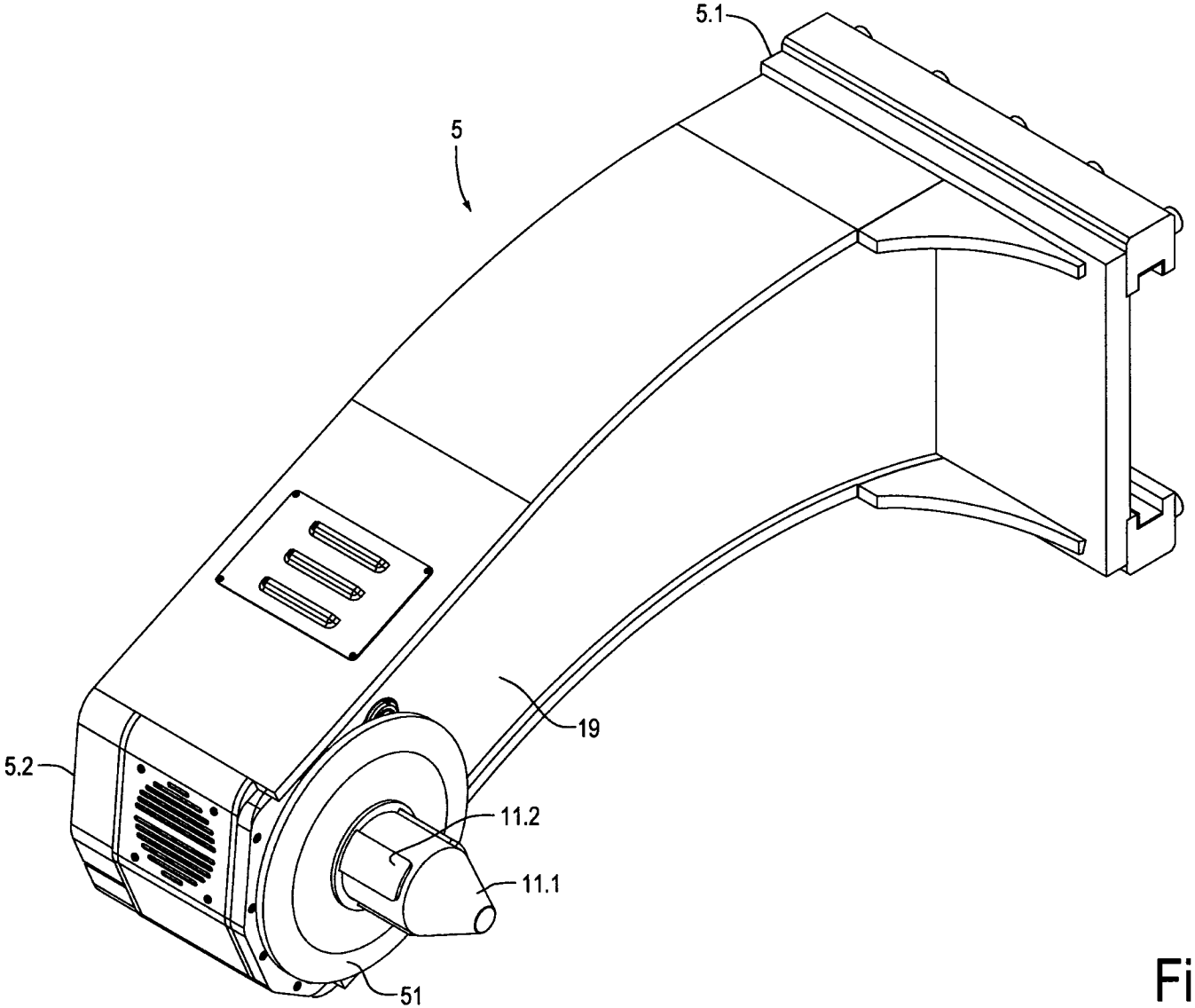

In some embodiments, the cylinder-piston actuator 33 has an annular shape and surrounds the tailstock shaft 11.3, as shown in FIGS. 3 and 5. More in particular, in the illustrated example the cylinder-piston actuator 33 has a cylinder 35 forming an annular chamber 36, inside which a piston 37 slides, also the piston having annular shape and surrounding the shaft 11.3 of the tailstock 11.

The cylinder-piston actuator 33 is a single-acting actuator. The supply of pressurized fluid inside the annular chamber 36 of the cylinder 35 pushes the annular piston 37 towards the bearing 15, so as to press the rotating rings 25 and the braking discs 27 against one another. When the fluid pressure in the annular chamber 36 decreases, the actuator is returned to the idle position by elastic return members, for example a helical spring 39. In the illustrated example, the helical spring 39 is coaxial with the stationary pin 29.

To have a particularly compact configuration, in advantageous embodiments the brake actuator 33 is housed in an annular body forming the cylinder 35 and also forming the seat, where a support bearing of the shaft 11.3 of the tailstock 11 is mounted. In the illustrated embodiment, the annular body forming the cylinder 35 houses the bearing 17. More in particular, in the illustrated embodiment the annular body forming the cylinder 35 has a seat 43 where the bearing 17 is mounted. In some embodiments, the annular body has a mounting flange 45, through which it is fastened to the transverse wall 21.

To dissipate the heat generated when the brake 23 is actuated, a ventilation system may be provided, for example comprising, or constituted by, a fan 47 circulating air in the housing 13 provided in the arm 5.

The described configuration is particularly compact, and allows to have a tailstock 11 with a particularly short shaft 11.3. Moreover, the end of the shaft 11.3 opposite to the truncated-conical end 11.1 of the tailstock 11 is free and can be accessed from the outside of the arm 5. In the illustrated embodiment, a lid 49 protects the shaft 11.3 and the rear bearing 17 thereof.

In possible embodiments, the back end of the shaft 11.3 can be accessed for coupling to a collector of compressed air or other fluid driving the expandable elements 11.2. Moreover, the back end of the shaft 11.3 can be accessed to apply an auxiliary motor thereto, if necessary with the interposition of a friction or the like. The motor can be used for rotating the tailstock 11 in a controlled manner, for example to unwind or to wind again the web material of the roll B.

The brake 23 is integrally housed inside the arm 5, between the transverse walls 19, 21 defining the housing 13, with a particularly compact configuration.

In some embodiments, an ejector can be associated with the tailstock 11 for facilitating the ejection of a winding core of the roll B, for instance for unloading a finished roll or simply for replacing a roll under processing with a different one for a subsequent job order. In some cases, by retracting the expandable elements 11.2 and moving the arms 5 parallel to the axis A-A of the tailstocks 11, thus spacing them from one another, situations can occur where the roll B, i.e. the winding rod thereof, remains locked on one of the tailstocks 11. The ejector is used to remove the core from the the tailstock 11 safely.

According to embodiments described herein, also the ejector has a compact configuration and is housed at least partially in the housing 13 between the transverse walls 19, 21.

In the illustrated embodiment, the ejector comprises a movable plate 51 coaxial with the tailstock 11 and surrounding the tailstock shaft 11.3. The movable plate 51 is pushed towards the transverse wall 19 when the tailstock 11 is inserted in an end of the roll B. In order to facilitate the extraction of the tailstock 11 from the tubular core of the roll B, the movable plate 51 may be pushed against the tubular core (not shown) according to arrow f51. The pushing according to the arrow f51 is controlled by an ejection actuator.

In some embodiments, the ejection actuator comprises one or more pneumatic or hydraulic cylinder-piston actuators.

In the illustrated embodiment, the ejection actuator comprises two cylinder-piston actuators 53, 55. The two cylinder-piston actuators of the ejection actuator are double-acting actuators and are advantageously arranged in series. This means that it is possible to supply pressurized control fluid to a first chamber of one of the cylinder-piston actuators 53, 55, for example to the chamber opposite to the movable plate 51 of the cylinder-piston actuator 55, as schematically represented by the arrow (A). The fluid in the second chamber of the cylinder-piston actuator 55 is discharged (arrow (B)). The second chamber of the cylinder-piston actuator 55 is connected to the chamber of the cylinder-piston actuator 53 opposite to the movable plate 51, where the fluid enters according to the arrow (C). The ejection movement causes the fluid to exit from the second chamber of the cylinder-piston actuator 53 according to the arrow (D). In this way, supplying pressurized fluid according to the arrow (A) causes the simultaneous synchronous actuation of both the actuators 53, 55, pushing the movable plate 51 in the direction of arrow f51. The two pistons of the cylinder-piston actuators 53, 55 are constraint to make the same stroke, independently of any resistance while moving.

In order to return the movable plate 51 to the retracted position, it is possible simply to push the winding rod of the roll B against the plate 51, moving the arm 5 towards the roll, with the tailstock 11 centered with the axial hole of the winding rod of the roll B. The movement of the movable plate 51 in the direction opposite to arrow f51 makes the working fluid enter, according to a direction opposite to the arrow (C), into the left chamber (left in the drawing) of the actuator 55, causing the fluid to exit from the right chamber of the actuator in a direction opposite to arrow (B) and to enter the left chamber of the actuator 53. The movement of the piston of the actuator 53 discharges the fluid from the right chamber in a direction opposite to arrow (A).

In this way, with a simple circuit with two ducts connected to the circuit of the working fluid, for example oil, it is possible to have a double pushing onto the movable plate 51, as the actuators 53 and 55 are arranged in diametrically opposite positions (i.e. offset by 180°) around the axis A-A of the shaft 11.3 of the tailstock 11.

What is claimed is:

1. An arm for an unwinder for unwinding rolls, comprising:

an axial engaging member, for engaging the unwinding rolls, having a shaft supported by at least two support bearings mounted on the arm, so as to rotate around a rotation axis; and a brake adapted to act on the shaft;

wherein the brake is at least partially arranged between the at least two support bearings; and wherein the brake comprises:

at least one rotating ring, rotatingly coupled to the shaft and rotating therewith;

at least one braking disc coaxial with the shaft, wherein the at least one rotating ring and the at least one braking disc are movable with respect to each other in a direction parallel to the rotation axis of the shaft;

and a brake actuator adapted to press said at least one rotating ring and said at least one braking disc against each other;

wherein said at least one braking disc and said at least one rotating ring are arranged between the at least two support bearings.

2. The arm of claim 1, wherein the brake is integrally housed in a space between said at least two support bearings.

3. The arm of claim 1, further comprising two walls transverse with respect to the rotation axis of the shaft, wherein the at least two support bearings are in a space defined between said two walls.

4. The arm of claim 1, wherein the brake comprises:

at least one further rotating ring, rotatingly coupled to the shaft and rotating therewith;

at least one further braking disc coaxial with the shaft, wherein the at least one further rotating ring and the at least one further braking disc are movable with respect to one another in a direction parallel to the rotation axis of the shaft;

wherein the brake actuator is adapted to press said at least one further rotating ring and said at least one further braking disc against one another, and the at least one further braking disc and the at least one further rotating ring is arranged between the at least two support bearings.

5. The arm of claim 1, wherein the brake actuator is housed inside the arm at least partially between said at least two support bearings.

6. The arm of claim 1, wherein the brake actuator is a cylinder-piston actuator.

7. The arm of claim 6, wherein the brake actuator is a single-acting cylinder-piston actuator.

8. The arm of claim 1, wherein the brake actuator has an annular shape and surrounds said shaft.

9. The arm of claim 1, further comprising an ejector, adapted to eject a roll from the axial engaging member; and an ejection actuator.

10. The arm of claim 9, wherein the ejector comprises:

a movable plate mounted coaxially with the shaft of the axial engaging member and adapted to move axially with respect thereto controlled by the ejection actuator.

11. The arm of claim 9, wherein the ejection actuator is housed in the arm.

12. The arm of claim 9, wherein the ejection actuator comprises at least one cylinder-piston actuator.

13. The arm of claim 9, wherein the ejection actuator comprises two cylinder-piston actuators arranged in series with respect to each other and arranged in positions diametrically opposite with respect to the rotation axis of the shaft.

14. The arm of claim 1, wherein the brake is housed in a housing provided at an end of the arm, and wherein the arm further comprises a ventilation system for removing from said housing heat generated by brake friction.

15. An unwinder for unwinding rolls of web material, comprising a bearing structure and at least one pair of arms supported movable with respect to the bearing structure; wherein each arm of said at least one pair of arms comprises:

an axial engaging member, for engaging the unwinding rolls, having a shaft supported by at least two support bearings mounted on the arm, so as to rotate around a rotation axis; and a brake adapted to act on the shaft; wherein the brake is at least partially arranged between the at least two support bearings;

wherein the brake comprises:

at least one rotating ring, rotatingly coupled to the shaft and rotating therewith;

at least one braking disc coaxial with the shaft, wherein the at least one rotating ring and the at least one braking disc are movable with respect to each other in a direction parallel to the rotation axis of the shaft;

and a brake actuator adapted to press said at least one rotating ring and said at least one braking disc against each other; and wherein said at least one braking disc and said at least one rotating ring are arranged between the at least two support bearings.

16. The unwinder of claim 15, wherein the arms are provided with a motion towards and away from each other, and with a motion for translating a roll engaged by the same arms.

17. The unwinder of claim 15, wherein said arms are provided with a synchronous rotation motion with respect to the bearing structure, around an axis parallel to the rotation axis of the respective shafts of the axial engaging members.

18. An unwinder for unwinding rolls of web material, comprising a bearing structure and at least one pair of arms supported movable with respect to the bearing structure; wherein each arm of the at least one pair of arms comprises an axial engaging member, for engaging the unwinding rolls, having a shaft supported by at least two support bearings mounted on the arm, so as to rotate around a rotation axis;

a first side wall and a second side wall transverse to the axial engaging member, the first side wall and the second side wall defining a housing through which the shaft extends;

of said at least two support bearings, a first support bearing is arranged at said first side wall and a second support bearing is arranged at said second side wall;

a brake adapted to act on the shaft, wherein the brake is arranged in the housing between the first support bearing and the second support bearing and between the first side wall and the second side wall.

19. The unwinder of claim 18, wherein the brake includes a brake actuator, wherein the brake actuator has an annular shape and surrounds said shaft.

20. The unwinder of claim 18, wherein each said arm of said at least one pair of arms comprises an ejector adapted to eject a roll from the axial engaging member and comprising an ejection actuator.

21. The unwinder of claim 20, wherein the ejector comprises a movable plate mounted coaxially with the shaft of the axial engaging member and adapted to move axially with respect thereto controlled by the ejection actuator.

22. The unwinder of claim 20, wherein the ejection actuator is housed in the arm.

23. The unwinder of claim 20, wherein the ejection actuator comprises at least one cylinder-piston actuator.

24. The unwinder of claim 20, wherein the ejection actuator comprises two cylinder-piston actuators arranged in series with respect to each other and arranged in positions diametrically opposite with respect to the rotation axis of the shaft.

25. The unwinder of claim 18, wherein each said arm of said at least one pair of arms comprises a ventilation system for removing from said housing heat generated by brake friction.

* * * * *